US006488230B2

(12) United States Patent
Porter

(10) Patent No.: US 6,488,230 B2
(45) Date of Patent: Dec. 3, 2002

(54) STATIONARY WEB SPREADER

(75) Inventor: Steven S. Porter, Hillsboro, OR (US)

(73) Assignee: Coorstek, Inc., Hillsboro, OR (US)

( * ) Notice: Subject to any disclaimer, the term of this patent is extended or adjusted under 35 U.S.C. 154(b) by 19 days.

(21) Appl. No.: 09/755,552

(22) Filed: Jan. 3, 2001

(65) Prior Publication Data

US 2002/0084380 A1 Jul. 4, 2002

(51) Int. Cl.[7] ..... B65H 23/32; D06C 3/06

(52) U.S. Cl. ..... 242/615.21; 242/615.4; 226/196.1; 26/87; 26/101

(58) Field of Search ..... 226/196.1, 88; 242/615.12, 615.21, 615.4; 26/87, 99, 101, 102

(56) References Cited

U.S. PATENT DOCUMENTS 920,122 A * 5/1909 Farnworth ..... 26/102
3,344,493 A * 10/1967 Telgheider ..... 26/99
4,035,878 A 7/1977 Cheatham
4,194,275 A * 3/1980 Frueler ..... 26/100
4,223,426 A * 9/1980 Demiere ..... 26/103
4,239,141 A 12/1980 Frye
4,239,142 A * 12/1980 Schonmeier et al. ..... 26/102 X
4,697,728 A 10/1987 Sawyer, Sr. et al.
5,076,894 A 12/1991 Simmons et al.
5,855,672 A 1/1999 Eichinger et al.
6,113,026 A 9/2000 Pottorff

* cited by examiner

*Primary Examiner*—Michael R. Mansen
*Assistant Examiner*—Minh-Chau Pham
(74) *Attorney, Agent, or Firm*—Klarquist Sparkman, LLP

(57) ABSTRACT

Bowed spreader apparatus for laterally stretching, or stressing, a web of material carried in a selected direction along a conveyor path includes an elongate stationary spreader bar extending laterally of the path. The spreader bar has a web support face which is convexly curved both about the longitudinal axis of the bar and along the longitudinal axis. The bar includes a formed elongate support body having a degree of flexibility allowing the body to be bent in a bowed configuration. A face surface of the body is formed in a convex curve about the longitudinal axis of the body and a plurality of hardened elements are individually secured to and cover the face surface of the support body. An underlying interchangeable profiling support having a convexly curved upper surface forms the spreader bar into a selected bowed configuration.

27 Claims, 2 Drawing Sheets

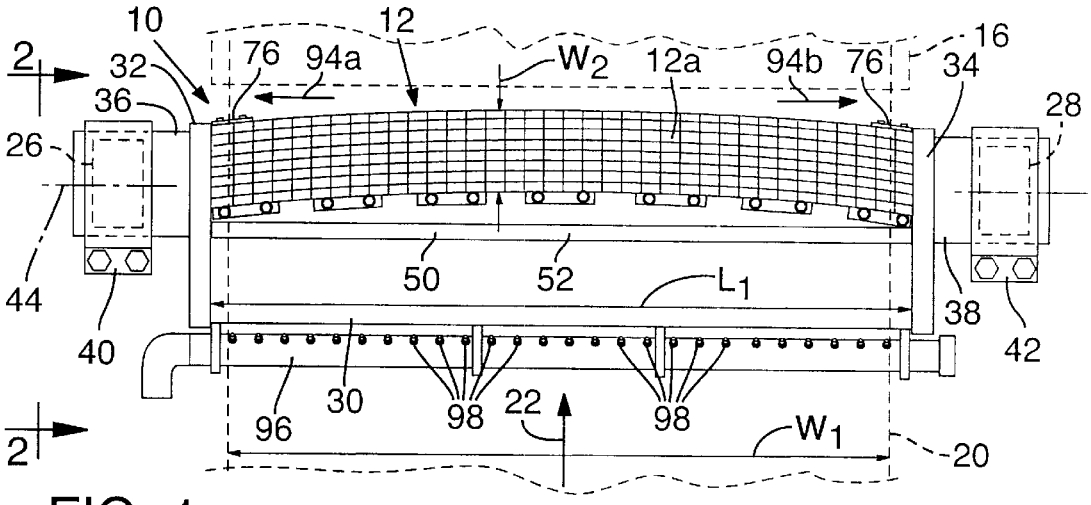
FIG. 1
FIG. 2
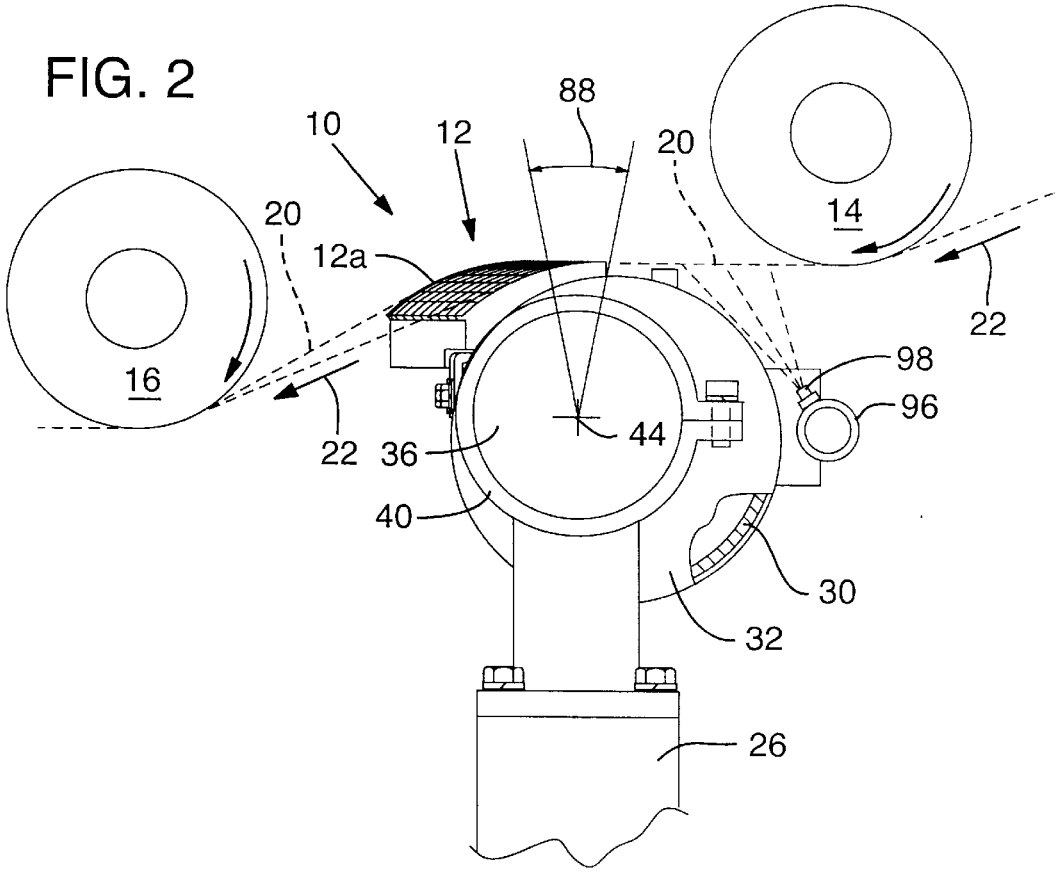

STATIONARY WEB SPREADER

BACKGROUND OF THE INVENTION

Field of the Invention

The present invention relates generally to apparatus for laterally stressing, or stretching, a web of material carried in a selected direction along a conveyor path. More specifically, it relates to a stationary bowed spreader bar over which the web of material is carried.

SUMMARY OF THE INVENTION

In the manufacturing of paper and other flexible sheet materials, a web of such material may be carried in a selected direction along a conveyor path and is guided along such path by rollers. The material may be carried on a conveyor belt which may be made of metal wire, woven plastic, or other web carrying materials.

As the conveyor and web are carried through the process it may be necessary or desirable to provide a lateral stressing, or stretching, of the material either to remove wrinkles or other deviations, or to align the materials within the conveyor.

In the past various spreader rolls, or bowed rolls, have been used. These prior rolls have an outwardly bowed, or curved shape, and rotate about a fixed axle. Various operational problems occur with such devices, such as lubrication and flexural failures.

A general object of the present invention is to provide apparatus including a substantially stationary bowed spreader over which a web of material may be carried along a selected direction in a conveyor path, with the apparatus laterally stressing, or stretching, the web and overcoming many of the problems that have occurred in prior roller devices.

Another object of the present invention is to provide spreader apparatus which includes an elongate stationary spreader bar supported adjacent and extending substantially laterally of the conveyor path, the bar having a web support face which is convexly curved both about the longitudinal axis of the bar and along the longitudinal axis of the bar such that a web of a material carried thereover under tension is urged to spread, or stretch, laterally.

A further object of the invention is to provide such apparatus in which the spreader bar comprises a formed elongate support body having a degree of flexibility allowing the body to be bent into a bowed curve along its longitudinal axis and a plurality of hardened elements individually secured to and covering the face surface of the support body to form a web carrying face for the spreader bar.

A still further object of the invention is to provide such apparatus with a profiling support interposed between the base and support body to bend the support body into a desired bowed configuration. More specifically, the profiling support has a side which engages the carrier bar and is configured to bend the bar into a desired bowed configuration. Interchangeable profiling supports may be used to provide different bowed configurations for the bar.

Yet another object is to provide such apparatus in which the hardened elements are disposed in multiple rows and columns extending across the face surface of the support body with the hardened elements being secured at their rear faces to the support body and with front faces thereof forming the web carrying surface. Edge margins of an element are contiguous but unjoined to edge margins of adjacent elements, to permit bending of the carrier bar to varying bowed configurations.

BRIEF DESCRIPTION OF THE DRAWINGS

Other objects and advantages of the present invention will be apparent from the following detailed description of a preferred embodiment and from the attached drawings wherein:

FIG. 1 is a top plan view of spreader apparatus according to an embodiment of the invention;

FIG. 2 is an enlarged side elevation view taken generally along the line 2—2 in FIG. 1;

DESCRIPTION OF PREFERRED EMBODIMENT

Figure 3:
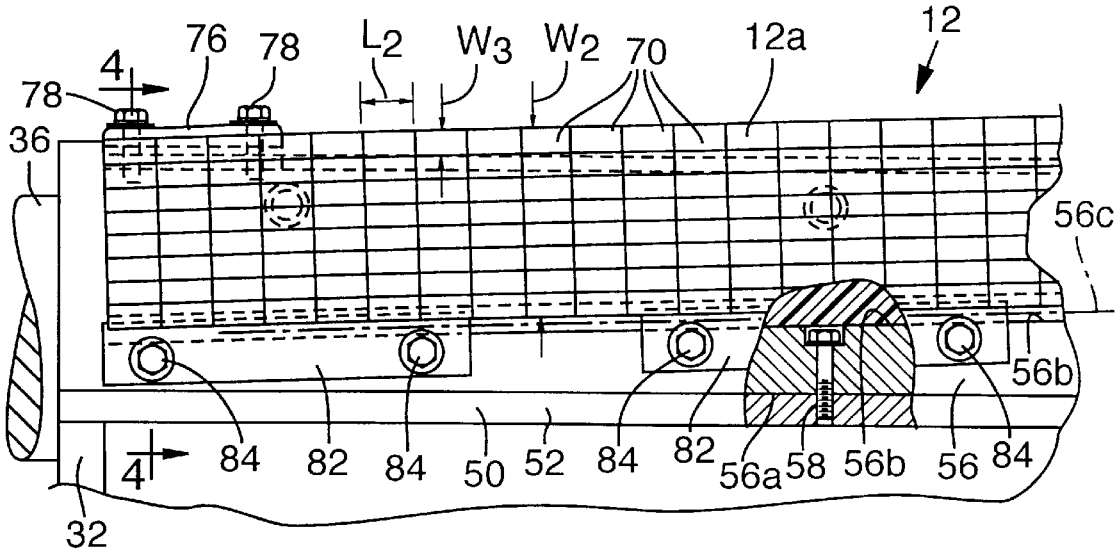
FIG. 3 is an enlarged top plan view of the left end portion of the spreader apparatus shown in FIG. 1.

Referring first to FIGS. 1 and 2, apparatus according to the present invention is indicated generally at 10. It includes a bowed spreader bar, or spreader bar assembly, 12, disposed in a conveyor line between a pair of upstream and downstream rollers 14, 16. Shown generally in dashed outline is a conveyor belt, wire, or fabric 20, used in papermaking to carry a web of material under each of rollers 14, 16 and across the upper web-carrying face 12*a* of spreader bar 12. Rollers 14, 16 rotate clockwise as illustrated in FIG. 2 and the web, belt, wire, or fabric, 20 is carried along a conveyor path in the direction of arrows 22. As illustrated in FIG. 1, the web or conveyor belt 20 has a width $W_1$ as measured laterally of the direction of the path along which it travels.

A pair of support columns 26, 28 are disposed laterally to opposite sides of the path for conveyor 20. Spreader bar assembly 12 is disposed between and supported on support columns 26, 28 as will be described below.

In the illustrated embodiment of the invention, an elongate substantially rigid tubular cylinder 30 having circular end plates 32, 34 secured thereon extends laterally of the conveyor path between support columns 26, 28. A pair of pivot shafts 36, 38 are secured to end plates 32, 34, respectively, and extend outwardly therefrom as illustrated in FIG. 1. Pivot shafts 36, 38 are received in clamp couplings 40, 42. Each of the clamp couplings surrounds the periphery of its associated pivot shaft and has securing bolts associated therewith. When the bolts are loosened the pivot shafts and cylinder 30 coupled thereto may be rotated about pivot axis 44.

Figure 4:
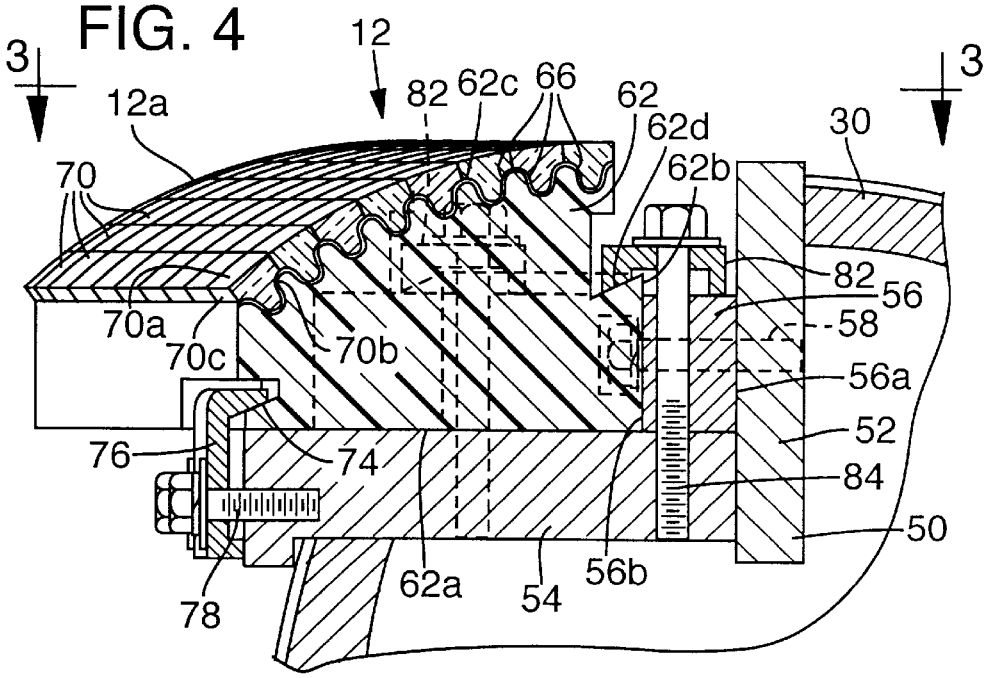
FIG. 4 is an enlarged cross sectional view taken generally along the lines 4—4 in FIG. 3.

As seen in FIGS. 2 and 4, at least a portion of a quadrant of cylinder 30 has been removed and an elongate, somewhat L-shaped, support base 50 has been secured thereto, as by welding. The support base includes an elongate base bar 52 and an elongate backing bar 54. These extend substantially the full length of cylinder 30 and provide a substantially rigid support base for the spreader bar 12.

Resting against both of base bar 52 and backing bar 54 is an elongate profiling support 56. The profiling support is a substantially rigid member which extends substantially the full length of cylinder 30 and has a planar underside, or inner side, 56*a* which rests flush against base bar 52. The upper, or outer, face, or surface, 56*b* of the profiling support is formed in a curved, or bowed, configuration. This upper, or outer, face is formed in a convex curve extending from its opposite ends toward its center, with the least elevation, or distance, from base bar 52 being at opposite ends of the base bar and its greatest upper surface elevation, or distance, being at the center. The profiling support 56 is secured to base bar 52, as by the use of bolts 58.

The spreader bar 12 comprises a formed elongate support body 62 having the cross sectional configuration illustrated generally in the cross hatched portion of FIG. 4. As is seen, it has a substantially flat back side 62*a* which rests against backing bar 54, a substantially flat bottom surface 62*b* which rests against the upper face 56*b* of profiling support 56, and a convexly curved outer face surface 62*c*. Face surface 62*c* is formed in a convex curve which extends about the longitudinal axis of support body 62. Further, a plurality of elongate grooves 66 extending longitudinally of body 62 are formed in outer surface 62*c*.

Body 62 is formed of a plastic material, which may be a fiber reinforced plastic material, which is capable of being flexed into a bow shaped configuration. Explaining further, the support body 62 initially is formed as a substantially straight element with no bowing along its longitudinal axis. The support body has a length $L_1$ corresponding substantially to the length of cylinder 30, such that it fits within the space between end plates 32, 34 and extends transversely of the conveyor path. The support body also has a width $W_2$ measured in the direction of path 22.

A plurality of hardened elements 70 are secured to the outer face surface of support body 62 to form a web carrying face for the spreader bar. The hardened elements 70 are ceramic tiles which, when viewed as in FIG. 3, have a substantially rectangular configuration. The tiles each have a front face 70*a* which, when assembled as illustrated, face outwardly to form a web carrying face surface for the spreader bar. Each tile has a rear face 70*b* opposite the front face which comprises a tongue portion which extends from the rear face and is received in a groove 66 in the face surface of support body 62. An adhesive in groove 66 bonds these rear surfaces of the tiles and their tongue portion 70*b* to support body 62. Each tile also has surrounding edge margins 70*c* extending between their front and rear faces and defining the substantially rectangular configuration for the illustrated tiles.

The tiles are individually secured to the outer face 62*c* of support body 62 in such a manner that they substantially cover the convex outer face of the support body. The edge margins of the individual tile elements are contiguous but unjoined to edge margins of adjacent tiles on the face. As is best seen in FIG. 3, the tiles are secured to the outer face of support body 62 in multiple rows and columns. In the embodiment illustrated, each column holds 8 tiles, and each row holds on the order of 35 tiles. The number of tiles shown in each column and row is merely exemplary. It has been found that the apparatus works well when the support body has a length $L_1$ which is at least as great and maybe slightly greater than width $W_1$ for the conveyor to be carried thereover, and each tile element has a first side-to-side dimension, or length, $L_2$ in the direction of the length of the support body which is less than 10% of the length $L_1$ of the support body. The side-to-side dimension, or width, $W_3$ of a tile 70 as measured in the direction of the width of the support body, in the illustrated embodiment, is between 10–25% of width $W_2$ of the support body. However width $W_2$ may be less than or greater than this range. The primary purpose of having multiple individually secured tile elements, each of which is only a minor portion of the length of the support body, is to permit bowing of the support body, while maintaining substantial covering by the tile elements over the web carrying face of the spreader bar.

The support body is secured to base 50 and profiling bar 56 as best illustrated in FIGS. 3 and 4. Support body 62 has notches 74 formed at its opposite ends as best illustrated in FIG. 4. An angle bar 76 is engaged in notch 74 and is secured to support base 50 by bolts 78. In this way, opposite end portions of support body 62 are held in place relative to base 50.

As previously mentioned, upper surface 56*b* of profiling support 56 has been machined into a convexly curved configuration conforming to the bowed configuration which it is desired that spreader bar 12 assume in the apparatus. Profiling support 56 is interposed between bottom surface 62*b* of support body 62 and base bar 52, such that it is in contact with bottom surface 62*b* of support body 62 throughout substantially the length of the spreader bar. Due to the flexibility of support body 62, it is forced into a bowed configuration along its longitudinal axis as best illustrated in FIGS. 1 and 3. Since the multiple tiles 70 are not joined to each other along their contiguous edge margins they permit such bending of support body 62. The spreader bar thus has an outer surface extending substantially across the width of the traveling web which has an outer face surface formed in a convex curve which is curved about the longitudinal axis of the spreader bar and a convex bowed configuration which is curved along the longitudinal axis over which the conveyor web may extend. The spreader bar is bowed generally in the direction of movement 22 of the material to be conveyed thereover.

As is best seen in FIGS. 3 and 4, a plurality of elongate clamp members 82 secure body 62 to profiling support 56 and to base 50 through bolts 84. As seen in FIG. 4, support body 62 has a somewhat dovetail shaped portion 62*d* engaged by clamp 82 to draw the bottom 62*b* tightly against the top surface of profiling support 56.

It should be understood that multiple profiling supports machined to different curved configurations may be interchanged with the profiling support 56 illustrated to produce a different bowed configuration for spreader bar 12. With the bolt and clamp structure described it is a simple matter to remove the support body 62, and one profiling support 56, substitute a second profiling support of a different curved configuration, and then replace the support body. A second profiling support of slightly different curvature is indicated schematically by dashed line 56*c* in FIG. 3.

The spreader bar 12 is illustrated in a first position in FIGS. 2 and 4. As previously noted, clamps 40, 42 may be released and the spreader bar apparatus rotated about pivot axis 44 (within an arc indicated generally at 88 in FIG. 2) to vary the orientation of the bar relative to the path of a web to be carried thereover.

As seen in FIGS. 1 and 2 an elongate sprayer tube 96 is secured to cylinder 30 and has a plurality of nozzles 98 arrayed at spaced intervals therealong. Water, or other liquid as desired, may be fed under pressure into the tube 96 and sprayed outwardly through nozzles 98 onto the under side of web 20 prior to the web engaging spreader bar 12.

As a web of material is carried along path 22 it moves over the spreader bar under tension. As it moves over the spreader bar the bowed configuration of the bar extending generally in the direction of the path of travel of the conveyor web causes the conveyor and a web of material carried thereon to be stressed, or stretched, laterally in the directions of arrows 94*a*, 94*b*, prior to engaging roll 16.

While a preferred embodiment of the invention has been described herein, it should be apparent to those skilled in the art that variations and modifications are possible without departing from the spirit of the invention.

What is claimed is:

1. Bowed spreader apparatus for laterally stressing a web of material carried in a selected direction along a conveyor path comprising an elongate stationary spreader bar supported adjacent and extending substantially laterally of said path, said spreader bar having a web support face which is convexly curved both about the longitudinal axis of the bar and along the longitudinal axis of the bar, such that the web of material carried thereover under tension is urged to spread laterally, the bar comprising a formed elongate support body having a degree of flexibility allowing the body to be bent into a bowed curve along its longitudinal axis, with a face surface of the body formed in a convex curve about the longitudinal axis of the body, and a plurality of rigid wear-resistant elements individually secured to and covering the face surface of the support body to form the web support face for the spreader bar, an elongate base extending laterally of the conveyor path with said support body secured to said base, and a profiling support interposed between the base and support body to bend the support body into a desired bowed configuration.

2. The apparatus of claim 1, wherein said profiling support has a side which engages said support body and said side is configured to bend the support body into said desired bowed configuration.

3. The apparatus of claim 1, wherein said wear-resistant elements have ceramic faces oriented to produce said web support face.

4. The apparatus of claim 3, wherein said wear-resistant elements are ceramic tiles.

5. Bowed spreader apparatus for laterally stressing a web of material carried in a selected direction along a conveyor path comprising an elongate stationary spreader bar supported adjacent and extending substantially laterally of said path, said spreader bar having a web support face which is convexly curved both about the longitudinal axis of the bar and along the longitudinal axis of the bar, such that the web of material carried thereover under tension is urged to spread laterally, the bar comprising a formed elongate support body having a degree of flexibility allowing the body to be bent into a bowed curve along its longitudinal axis, with a face surface of the body formed in a convex curve about the longitudinal axis of the body, and a plurality of rigid wear-resistant elements individually secured to and covering the face surface of the support body to form the web support face for the spreader bar, said elements being disposed in multiple rows and columns across the face surface of the support body.

6. Bowed spreader apparatus for laterally stressing a web of material carried in a selected direction along a conveyor path comprising an elongate stationary spreader bar supported adjacent and extending substantially laterally of said path, said spreader bar having a web support face which is convexly curved both about the longitudinal axis of the bar and along the longitudinal axis of the bar, such that the web of material carried thereover under tension is urged to spread laterally, the bar comprising a formed elongate support body having a degree of flexibility allowing the body to be bent into a bowed curve along its longitudinal axis, with a face surface of the body formed in a convex curve about the longitudinal axis of the body, and a plurality of rigid wear-resistant elements individually secured to and covering the face surface of the support body to form the web support face for the spreader bar, an elongate base extending laterally of the conveyor path with said support body secured to said base, and a profiling support interposed between the base and support body to bend the support body into a desired bowed configuration, said profiling support having a side which engages said support body and is configured to bend the support body into said desired bowed configuration, said profiling support is removable and may be interchanged with another profiling support of a different configuration to bend said support body into a different bowed configuration.

7. The apparatus of claim 6, which further comprises adjustment mechanism on which said spreader bar is mounted permitting pivoting of the spreader bar about its longitudinal axis.

8. Bowed spreader apparatus for laterally stressing a web of material carried in a selected direction along a conveyor path comprising an elongate stationary spreader bar supported adjacent and extending substantially laterally of said path, said spreader bar having a web support face which is convexly curved both about the longitudinal axis of the bar and along the longitudinal axis of the bar, such that the web of material carried thereover under tension is urged to spread laterally, the bar comprising a formed elongate support body having a degree of flexibility allowing the body to be bent into a bowed curve along its longitudinal axis, with a face surface of the body formed in a convex curve about the longitudinal axis of the body, and a plurality of rigid wear-resistant elements individually secured to and covering the face surface of the support body to form the web support face for the spreader bar, said elements being disposed in multiple rows and columns extending across the face surface of the support body, each element having a front face, a rear face opposite said front face, and surrounding edge margins between said front and rear faces, said elements being secured at their rear faces to said support body with edge margins of an element contiguous but unjoined to edge margins of adjacent elements.

9. The apparatus of claim 8, wherein said support body is a plastic material.

10. The apparatus of claim 8, wherein said support body is a fiber-reinforced plastic material.

11. The apparatus of claim 8, wherein said support body has grooves formed in its face surface and each element has a tongue portion which extends from said rear face and is received in a groove in said face surface.

12. The apparatus of claim 11, which further comprises an adhesive bonding material securing said tongue portion in said groove.

13. The apparatus of claim 8, wherein said support body has a selected length and a selected width and each element has a first side-to-side dimension in the direction of said length which is less than 10% of said length.

14. Apparatus for supporting a travelling web of material carried in a selected direction along a conveyor comprising an elongate stationary carrier bar for guiding the travelling web, said bar including an elongate formed support body having a degree of flexibility allowing it to be bent into a selected bowed curve along its longitudinal axis, a convex rounded surface disposed adjacent the web, said surface extending substantially across a width of the travelling web, and a plurality of rigid wear-resistant elements individually secured to and covering the convex surface of the support body to form a web carrying face for the carrier bar, an elongate substantially inflexible base extending laterally of the conveyor path and mounted adjacent the conveyor path, upon which base the carrier bar is mounted, and a profiling support interposed between said base and carrier bar to bend the carrier bar into a desired bowed configuration, said profiling support comprising an elongate member having a first longitudinally extending surface which is supported by said base, and a second longitudinally extending surface on an opposite side of said profiling support from said first surface, said second surface having a curved configuration of the bowed configuration to which said carrier bar is bent.

15. The apparatus of claim 14, wherein said carrier bar and profiling support are secured to said base whereby the carrier bar conforms to the bowed configuration of the profiling support.

16. The apparatus of claim 14, wherein opposed ends of said carrier bar are secured to said base, said profiling support is secured to said base in a region intermediate said opposed ends of the carrier bar and between said base and the carrier bar, and said carrier bar is secured to said profiling support intermediate opposed ends of the profiling support to conform to the bowed configuration of the profiling support.

17. The apparatus of claim 14, wherein said carrier bar is bowed in a direction substantially parallel to the direction of travel of the travelling web.

18. Apparatus for supporting a travelling web of material carried in a selected direction along a conveyor comprising an elongate stationary carrier bar for guiding the travelling web, said bar including an elongate formed support body having a degree of flexibility allowing it to be bent into a selected bowed curve along its longitudinal axis, a convex rounded surface disposed adjacent the web, said surface extending substantially across a width of the travelling web, and a plurality of rigid wear-resistant elements individually secured to and covering the convex surface of the support body to form a web carrying face for the carrier bar, an elongate substantially inflexible base extending laterally of the conveyor path and mounted adjacent the conveyor path, upon which base the carrier bar is mounted, a profiling support interposed between said base and carrier bar to bend the carrier bar into a desired bowed configuration, said profiling support comprising an elongate member having a first longitudinally extending surface which is supported by said base, and a second longitudinally extending surface on an opposite side of said profiling support from said first surface, said second surface having a curved configuration of the bowed configuration to which said carrier bar is bent; and a second profiling support having a bow shaped configuration different from that of said first-mentioned profiling support and said first-mentioned and second profiling supports are interchangeable in said apparatus to vary the bowed configuration of said carrier bar.

19. Apparatus for supporting a travelling web of material carried in a selected direction along a conveyor comprising an elongate stationary carrier bar for guiding the travelling web, said bar including an elongate formed support body having a degree of flexibility allowing it to be bent into a selected bowed curve along its longitudinal axis, a convex rounded surface disposed adjacent the web, said surface extending substantially across a width of the travelling web, and a plurality of rigid wear-resistant elements individually secured to and covering the convex surface of the support body to form a web support face for the carrier bar;

said elements being disposed in multiple rows and columns across the convex rounded surface;

an elongate substantially inflexible base extending laterally of the conveyor path and mounted adjacent the conveyor path, upon which base the carrier bar is mounted, and a profiling support interposed between said base and carrier bar to bend the carrier bar into a desired bowed configuration.

20. Apparatus for supporting a travelling web of material carried in a selected direction along a conveyor comprising an elongate stationary carrier bar for guiding the travelling web, said bar including an elongate formed support body having a degree of flexibility allowing it to be bent into a selected bowed curve along its longitudinal axis, a convex rounded surface disposed adjacent the web, said surface extending substantially across a width of the travelling web, and a plurality of rigid wear-resistant elements individually secured to and covering the convex surface of the support body to form a web support face for the carrier bar;

the elements are disposed in multiple rows and columns extending across the convex rounded surface, each element having a front face, a rear face opposite said front face, and surrounding edge margins between said front and rear faces, said elements being secured at their rear faces to said support body with edge margins of an element contiguous but unjoined to edge margins of an adjacent element;

an elongate substantially inflexible base extending laterally of the conveyor path and mounted adjacent the conveyor path, upon which base the carrier bar is mounted, and a profiling support interposed between said base and carrier bar to bend the carrier bar into a desired bowed configuration.

21. The apparatus of claim 20, wherein said support body is a plastic material.

22. The apparatus of claim 20, wherein said support body is a fiber-reinforced plastic material.

23. The apparatus of claim 20, wherein said support body has a selected length and a selected width and each element has a first side-to-side dimension in the direction of said length which is less than 10% of said length.

24. The apparatus of claim 23, wherein said elements have ceramic faces oriented to produce said web carrying face.

25. The apparatus of claim 24, wherein said elements are ceramic tiles.

26. Apparatus for supporting a travelling web of material in a selected direction along a conveyor comprising an elongate substantially inflexible base extending laterally of the conveyor path and supported adjacent the conveyor path, an elongate carrier bar mounted on the base for guiding the travelling web, said bar including an elongate flexible support body which may be bent into a bowed curve along its longitudinal axis, a convex rounded surface disposed adjacent the web, said surface extending substantially across a width of the travelling web, and a plurality of rigid wear-resistant elements individually secured to and covering the convex surface of the support body to form a web carrying face for the carrier bar, said carrier bar being secured adjacent opposite ends of the bar to the base, and an elongate profiling support interposed between said base and carrier to bend the carrier bar into a desired bowed configuration, said profiling support comprising an elongate member having a first longitudinally extending surface which is supported by said base, and a second longitudinally extending surface on the opposite side of said support from said first surface, said second surface curved in a configuration of the bowed configuration to which said carrier bar is bent.

27. The apparatus of claim 26, wherein said profiling support is secured to said base, and said carrier bar is secured to and rests closely against the second surface of said profiling bar to assume a bowed configuration conforming to the curved configuration of said second surface.

* * * * *